United States Patent [19]

Berry

[11] Patent Number: 4,993,626

[45] Date of Patent: Feb. 19, 1991

[54] SECURITY MAILBOX

[76] Inventor: Gerald W. Berry, Rural Rte. 1, Box 125, Maynard, Iowa 50655

[21] Appl. No.: 530,902

[22] Filed: May 29, 1990

[51] Int. Cl.[5] ..... B65D 91/00

[52] U.S. Cl. ..... 232/17; 232/47

[58] Field of Search ..... 232/34, 17, 47, 48

[56] References Cited

U.S. PATENT DOCUMENTS

| | | | |
|---|---|---|---|
| 3,401,875 | 9/1968 | Bruhns | 232/48 X |
| 3,735,919 | 5/1973 | Morgan | 232/17 |
| 3,758,027 | 9/1973 | Morgan | 232/48 X |
| 3,880,344 | 4/1975 | Earle | 232/17 |
| 3,960,317 | 6/1976 | Clement | 232/34 X |
| 4,753,386 | 6/1988 | Phillion | 232/48 X |
| 4,901,914 | 2/1990 | Burger | 232/35 |

*Primary Examiner*—Robert W. Gibson, Jr.

*Attorney, Agent, or Firm*—Zarley, McKee, Thomte, Voorhees & Sease

[57] ABSTRACT

A mailbox designed for storage of mail in a secure lower portion of the housing. The mailbox has a swingable mail shelf to divide the housing into upper and lower compartments with the mail shelf being moved from a substantially horizontal mail rest position to a downwardly inclined main dump position.

5 Claims, 2 Drawing Sheets

SECURITY MAILBOX

BACKGROUND OF THE INVENTION

1. Field of the Invention

The present invention generally relates to mailboxes.

2. Description of the Prior Art

Mailboxes are, of course, common and well-known. One problem that often occurs with mailboxes is easy access to mail during the time when the homeowners are gone. Put another way, mail continues to pile up in the mailbox and is not removed. This is mail highly susceptible to theft because of the easy accessibility by simply opening the box door. It is, of course, necessary that the box door be easily accessible for the mailman on a daily basis.

Thus, during periods of time when homeowners are gone, there is a substantial risk of security violations for mailboxes.

In the past there have been some attempts at development of more secure mailboxes which perform both the function of easy access for mail carriers, and at the same time provide some means for storage in a non-accessible box area. However, generally those that have been developed in the past are bulky, use complex mechanical elements that are susceptible to failure, and are in effect cost prohibitive for real world use.

Accordingly, there is a real and continuing need for the development of mailboxes having both easy access for mail carriers, and at the same time having secure areas that stored mail can be dumped to, while at the same time doing so with a minimum of mechanical parts and yet provide a cost-effective mailbox.

This invention has as its primary objective the fulfillment of this need.

Another objective of the present invention is to provide a mailbox which uses a weighted mail signal arm which moves concomitally with a mail shelf from a mail rest position where the arm is up to a mail dump position where the arm is down and blocking access to the bottom of the box.

A further objective of the present invention is to provide a mailbox with the above advantages which takes advantage of a weighted mail signal arm to move from a rest up position and when bumped off of the stop to a lower mail dump position.

DETAILED DESCRIPTION OF THE INVENTION

The invention as illustrated in FIGS. 1-6 is specifically shown with regard to mailboxes. It, of course, goes without saying that other types of security boxes may incorporate the same basic system and come within the scope of this invention. Its use is most specifically adapted for mail use, however, where it is necessary to provide continuing delivery access, and at the same time a secure storage area.

Figure 1:
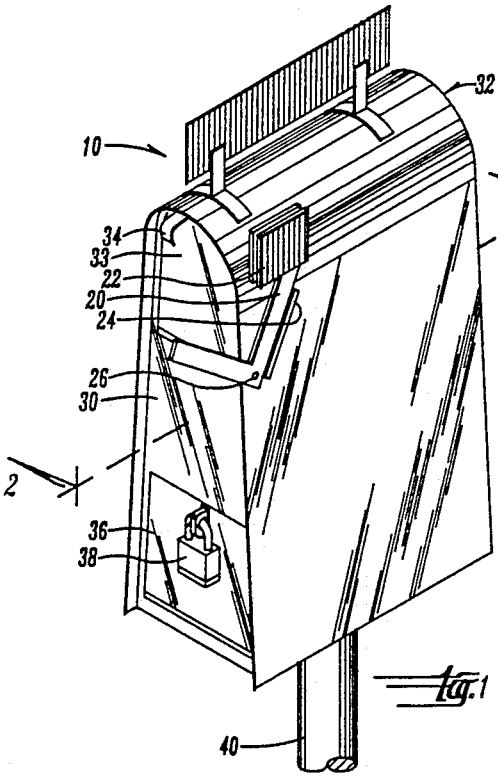
FIG. 1 is an elevated perspective view illustrating the present invention incorporated into a mailbox.
Figure 2:
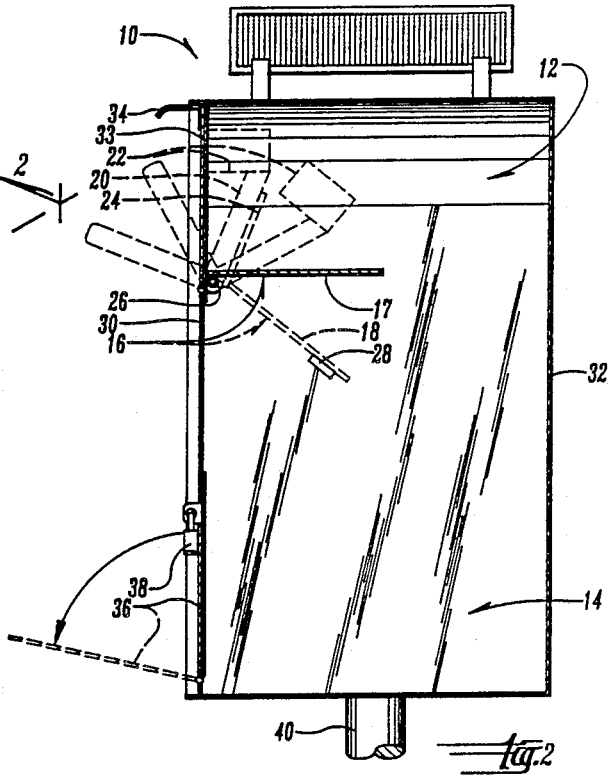
FIG. 2 is an elevated partial section along line 2—2 of FIG. 1.
Figure 3:
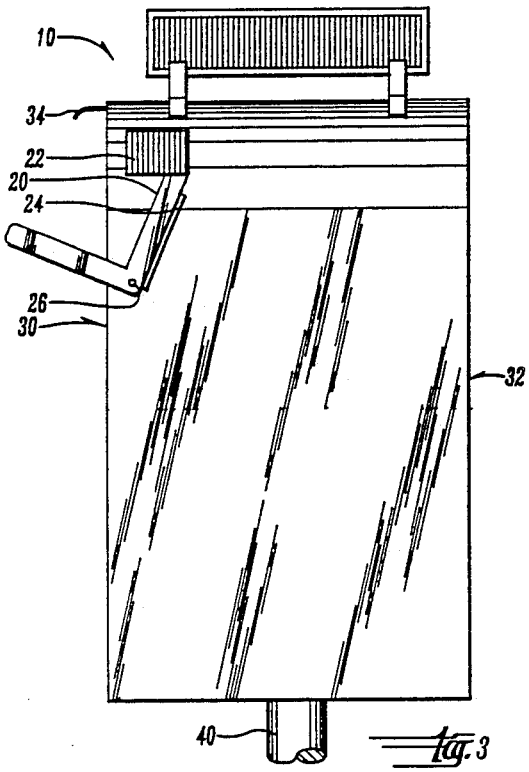
FIG. 3 is an elevated side view of the mailbox
Figure 4:
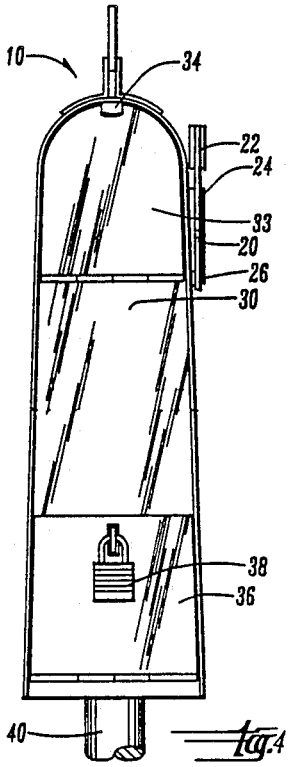
FIG. 4 is a front end view of the mailbox.
Figure 5:
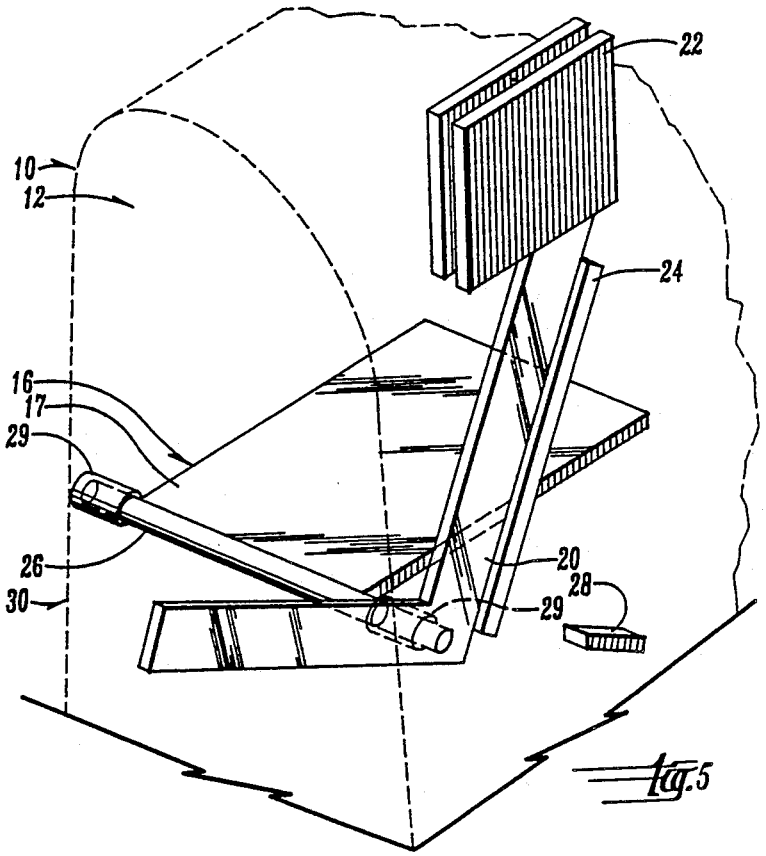
FIG. 5 is a fragmentary view showing the mail shelf in mail rest position.
Figure 6:
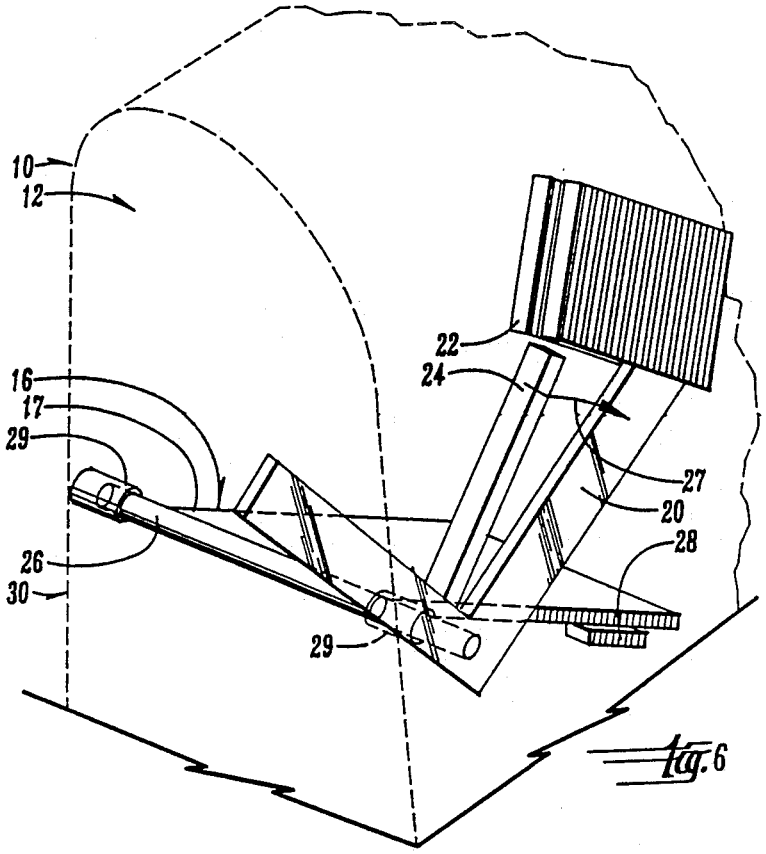
FIG. 6 is a partially fragmented view showing the interior of the box with the mail shelf in the lower or dump position.

The mailbox 10 includes a mail housing 12 which is divided into an upper portion 12 and a lower portion 14, with the dividing line between the upper and lower portions or compartments being a ma±1 shelf 16. Mail shelf 16 is comprised of a shelf or tray portion 17 and adjoined thereto a shaft 26. Shaft 26 is supported slidably in support bearings 29. Connected to the end of slide shaft 26 opposite support bearing 29 is signal arm 20. As illustrated in FIG. 2, the mail shelf 17 is movable from an upward or rest position, as illustrated at 16 to a lower position as illustrated at 18. Signal arm 20 is angular in shape and has a weighted head 22. Thus, in the upward or at-rest position, because of the weight of head 22 and the weight of shelf or plate 17, the signal arm 20 can rest against stop 24 which is attached to the exterior portion of housing 12. When it is desired to move the shelf to a lower or mail dump position, head 22 or any other part of the signal arm is hit with a person's hand causing it to slide outwardly, as indicated by directional arrow 27 of FIG. 6 at, which point by gravity the shelf falls to dump position illustrated in FIG. 6. The shelf is stopped in the lower or dump position by rest stop 28.

Housing 12 has a front end 30 and a rear end or wall 32. Wall 30 has upper mail access door 33 which is hinged in conventional fashion so that it can be opened by pull tab 34 to provide access to mail shelf 16.

Near the bottom of housing 12 is mail access door 36 which is accessible by lock 38. The mailbox can be mounted on a common vertical pedestal 40.

In actual operation, the mailbox can be used by mail carriers and homeowners in the following manner. If the homeowner has mail to go out, the flag or head 22 is up with the mail resting on shelf 16. Mail carrier approaches the box and pulls tab 34, opening door 32 and removes outgoing mail. The mail carrier then taps arm 20 to drop shelf 16 to a mail dump position. He then inserts the incoming mail which slides to a secure position in lower compartment 14.

In the event that the homeowner is away from home on a continuing basis, the mail carrier can similarly have access through mail access door 32 to the upper compartment and place mail on shelf 16. However, he can hit signal arm 20 which moves shaft 26 in a slidable manner to its out position, illustrated in FIG. 6, away from rest stop 24. As a result of the weight on arm 20 caused by shelf 16, signal arm 20 falls to its lower position and abuts against lower position rest 28. The shelf is then in lower position 18 (FIG. 2), and the mail is dumped to the lower compartment of housing 12. This can occur for as many days as the homeowner is gone. Access to this lower housing cannot be easily achieved since opening of door 32 and reaching therein simply provides access to the mail shelf only, and the shelf itself acts to stop the unauthorized entrant from being able to reach to the bottom of housing 12. Thus, the mail is secure.

When the homeowner comes home, the homeowner can simply unlock lock 38, providing access through door 36 to the mail in the bottom of the mailbox. Thus, the mail is kept secure.

Of course, lock means other than conventional padlock 38 can be used. Also, other types of doors can be used. However, there are certain constructional features that must be used in order to achieve the results of this invention. Those worthy of mention that achieve the combined beneficial result are the mail shelf having upper and lower positions, the use of a weighted signal arm on a common slidable shaft or axial with the mail shelf, the use of a mail shelf which itself functions as a barrier to prevent unauthorized entrance from having easy access to the bottom of the mailbox, and the simplicity of construction and minimum of moving parts.

The foregoing is considered as illustrative only of the principles of the invention. Further, since numerous modifications and changes will readily occur to those of mechanical skill, it is not desired to limit the invention to the exact construction and operation shown and described. Accordingly, all suitable modifications and equivalents may be resorted to, and are intended to fall within the scope of the invention herein described and below claimed.

What is claimed is:

1. A mail comprising:

a mail housing means;

a moveable shelf inside the housing means dividing the housing means into upper and lower compartments, the shelf being moveable between a substantially horizontal mail rest position and a downwardly angled mail drop position;

a connection means between the shelf and housing means for providing pivotal movement of the shelf about a generally horizontal axis between the mail rest and mail drop position, and allowing slideable movement along the horizontal axis;

a mail a signal arm operatively connected to the shelf outside the housing, movement of the arm causing responsive movement of the shelf;

the connected combination of the arm and shelf having a center of gravity urging the shelf to pivot from the mail rest to the mail drop position;

a first stop member on the housing corresponding to the mail rest position for the shelf;

a second stop member inside the housing corresponding with the mail drop position for the shelf;

the first stop member impeding pivotable movement of the arm and holding the shelf in the mail rest position when the arm is positioned substantially adjacent to the housing;

the seconded stop member impeding pivotable movement of the shelf and holding the shelf in the mail drop position when the arm is slideable moved to a position farther away from the housing so that the arm can pivot past the first stop member.

2. The mailbox of claim 1 wherein the mail signal arm is weighted and has an associated stop for resting in said mail rest position and when moved therefrom drops to said mail drop position.

3. The mailbox of claim 2 wherein said housing has an upper mail access door for access to said mail shelf.

4. The mailbox of claim 3 wherein said housing has a lower mail access door for access to the lower compartment of said mailbox housing.

5. The mailbox of claim 4 wherein said mailbox is mounted on a pedestal stand.

* * * * *